US008047033B2

(12) United States Patent
Kondo et al.

(10) Patent No.: US 8,047,033 B2
(45) Date of Patent: Nov. 1, 2011

(54) PLASTIC WORKING METHOD AND PLASTIC WORKING SYSTEM

(75) Inventors: Fumio Kondo, Nagoya (JP); Shoichi Takenouchi, Toyokawa (JP); Takayuki Nakanishi, Toyokawa (JP); Osamu Matsui, Toyokawa (JP)

(73) Assignees: Denso Corporation, Kariya (JP); Denso Preas Co., Ltd., Toyokawa (JP)

( * ) Notice: Subject to any disclaimer, the term of this patent is extended or adjusted under 35 U.S.C. 154(b) by 842 days.

(21) Appl. No.: 12/078,035

(22) Filed: Mar. 26, 2008

(65) Prior Publication Data

US 2008/0302153 A1 Dec. 11, 2008

(30) Foreign Application Priority Data

Jun. 6, 2007 (JP) ..... 2007-150718

(51) Int. Cl.
*B21B 37/48* (2006.01)

(52) U.S. Cl. ..... 72/8.6; 72/405.01; 72/421; 72/425; 226/24; 226/45; 226/115; 226/118.1

(58) Field of Classification Search ..... 72/8.6, 72/11.4, 1, 3, 404, 405.01, 425, 405.06, 419–421; 226/42, 8, 4, 24, 44, 45, 115, 118–118.3; 242/417, 417.3, 421.5–421.9, 420.3, 420.6
See application file for complete search history.

(56) References Cited

U.S. PATENT DOCUMENTS 3,817,067 A * 6/1974 Voorehes et al. ..... 72/11.4
3,974,949 A * 8/1976 Petersen ..... 226/42
4,561,581 A * 12/1985 Kelly ..... 226/113
6,744,490 B2 * 6/2004 Takamatsu et al. ..... 355/40
2004/0079780 A1 4/2004 Kato

FOREIGN PATENT DOCUMENTS

| | | |
|---|---|---|
| JP | A-8-1248 | 1/1996 |
| JP | A-9-215278 | 8/1997 |
| JP | A-9-216020 | 8/1997 |
| JP | A-9-237726 | 9/1997 |
| JP | A-2004-142876 | 5/2004 |

* cited by examiner

*Primary Examiner* — Dana Ross
*Assistant Examiner* — Matthew G Katcoff
(74) *Attorney, Agent, or Firm* — Oliff & Berridge, PLC

(57) ABSTRACT

A plurality of press devices 2 are arranged in a plastic working system. The plastic working system includes: a loop correction sensor 13 for watching a slack of a coil material C intermittently delivered from a preceding first press device 2*a*; and a second slack watching means 19 for watching a slack of the coil material C generated at the time of sending the coil material C to a succeeding second press device 2*b*. According to the slack generated by intermittent feeding of the coil material C sent from the first press device 2*a*, intermittent feeding is converted to continuous feeding by the feeding means 15. At the same time, the continuous feeding speed is subjected to speed increasing/decreasing control. On the other hand, by the second slack watching means 19, a slack of the coil material C is watched at the time of feeding the coil material C to the second press device 2*b* and the preceding first press device 2*a* is subjected to speed increasing/decreasing control.

4 Claims, 4 Drawing Sheets

PLASTIC WORKING METHOD AND PLASTIC WORKING SYSTEM

BACKGROUND OF THE INVENTION

1. Technical Field of the Invention

The present invention relates to a plastic working method and plastic working system, in the working line of which a plurality of plastic working devices are arranged and a workpiece can be smoothly supplied to the working devices and a high speed operation can be executed.

2. Description of the Related Art

In a conventional plastic working device, for example, a conventional press device is incorporated into a press working line to which a coil material, which is a workpiece, is supplied so that it can be worked by press working, the coil material is delivered from an uncoiler which holds and uncoils the coil material and the coil material is made to pass through a leveler which straightens the coil material and also made to pass through a section, in which a loop (slack or loosening) is generated, and the coil material is sent to a press device through an intermittently feeding mechanism so that the coil material can be subjected to press working.

In this case, the supply operation of coil material to the press device will be done intermittent to the press operation that repeats the movement and the stop. Which results in the coil material vibrating and flapping in some cases.

When the coil material flap as described above, not only the intermittently feeding mechanism receives an excessively heavy load, but also the coil material is bent and damaged which results in the material being erroneously fed. In order to reduce the flapping of the coil material, the following method is employed. For example, a pair of feed rollers having a servo motor are arranged before the intermittently feeding mechanism so that it can be used as a loop controller. The coil material is supplied to the intermittently feeding mechanism while an appropriate loop is being formed by these feed rollers.

Due to the above structure, the loop size of the coil material is detected. By this detection signal, a servo motor speed is controlled so as to control an amount of feed of the coil material. By this constitution, the coil material can be supplied to the intermittently feeding mechanism while an appropriate loop is being maintained. Therefore, flapping of the coil material can be minimized and the operation can be executed at high speed.

However, while the material to be processed is diversified, for instance, the size of the allowed loop is different for the difference of board thickness. Therefore, to form an appropriate loop, loop controller's installation position becomes a problem.

In order to solve the above problems, more flexibly, to supply the material in the high quality, JP-A-2004-142876 proposes the following coil material supply device. The coil material supply device for supplying a coil material to an intermittently feed device incorporated into a press device comprises: a coil material supply portion; a position sensor, which is arranged on the downstream side of this coil material supply portion, for detecting an amount of loop of the coil material; a control unit for controlling an amount of feed of the coil material executed by a feed roller when a servo motor is controlled by a signal sent from the position sensor; and a stand for holding the coil supply portion, the attaching angle of which can be changed so that a supply angle of the coil material can be changed in accordance with a condition of supplying the coil material.

However, JP-A-2004-142876 discloses a coil material supply device applied to a press working line in which press working is executed by one press device. Accordingly, improvement in production capacity is limited. Therefore, a press working line is proposed in which a plurality of press devices are arranged in series to each other and synchronously operated by a predetermined phase difference so as to enhance productivity.

However, this coil material supply device is disadvantageous in that even when the plurality of press devices are arranged in series to each other, a feed mechanism incorporated into each press device is intermittently operated. Therefore, due to the flapping generated in a workpiece located between the press devices, erroneous feeding is induced in the press device arranged before and after the coil material supply device. Accordingly, it is only possible to execute a low speed synchronous operation. Therefore, it is difficult to enhance productivity.

On the other hand, when the same working is executed not by an intermittent type device, but by a continuous feed type device, the occurrence of flapping of a workpiece can be reduced. However, the repetitive accuracy of the continuous feed type device is lower than that of the intermittent type device. Further, when the operation speed is increased, there is a fault that the decrease in accuracy repeatedly becomes remarkable.

SUMMARY OF THE INVENTION

The present invention has been accomplished to solve the above problems. An object of the present invention is to provide a plastic working method and plastic working system in which a plurality of plastic working devices are arranged, characterized in that: a loop of a workpiece intermittently outputted from a preceding plastic working device is watched and the workpiece is continuously sent out to the succeeding plastic working device so as to reduce an influence of the flapping of the workpiece located between the press devices and the workpiece can be stably fed to the succeeding plastic working device.

In order to solve the above problems, the invention described in claim 1 provides a plastic working system (1) in which a coil material (C), which is a workpiece, is intermittently sent to a plastic working device (2) and plastically worked, a plurality of plastic working devices (2) are arranged and the coil material (C) is worked by the plurality of plastic working devices in order, comprising: a first slack watching means (13) for watching a slack which is generated in the coil material (C) intermittently sent out from the plastic working device (2) by intermittent feeding; a second watching means (22) for watching a slack of the coil material (C) generated at the time of feeding the coil material (C) to a succeeding plastic working device (2); and a feed adjusting device (6) for controlling an operation speed of the preceding plastic working device (2) or a feeding speed at the time of feeding the coil material (C) to the succeeding plastic working device (2).

Due to the foregoing, for the coil material (C) intermittently sent out from the plastic working device (2), the operation of the plastic working device (2) is controlled and the feeding speed of the feed adjusting device (6) is controlled when a slack of the coil material (C) caused by intermittent feeding is watched and also when a slack of the coil material (C) sent out from the feed adjusting device (6) is watched. Due to the foregoing, a problem of the phenomenon of flapping of the coil material (C) caused by intermittent feeding of the coil material (C) can be solved and the coil material (C) can be stably fed to the succeeding plastic working device (2).

In the invention described in claim 2, the feed adjusting means (6) includes a feeding means (15) for continuously feeding a coil material (C) sent from the first slack watching means (13), operation of the feeding means (15) is controlled according to a slack, which is watched by the first slack watching means (13), caused by intermittent feeding of the coil material (C) which is sent from the preceding plastic working device (2*a*), and a slack of the coil material (C) at the time of feeding the coil material (C) to the succeeding plastic working device (2*b*) is watched by the second watching means (22) and operation of the preceding plastic working device (2*a*) is controlled.

Due to the foregoing, for the coil material (C) intermittently sent out from the plastic working device (2*a*), the operation of the plastic working device (2*a*) is controlled when the slack of the coil material (C) caused by intermittent feeding is watched and also when the slack of the coil material (C) sent out from the feed adjusting device (6) is watched.

Further, when the coil material (C) is sent out from the feed adjusting device (6), it is continuously sent out by the feeding means (15). Due to the foregoing, the flapping of the coil material (C) caused by intermittent feeding of the coil material (C) between the plastic working devices can be solved and the coil material (C) can be stably fed to the next plastic working device (2*b*).

In the invention described in claim 3, the first slack watching means (13) includes a first and a second proximity sensor (13*a*, 13*b*) for executing the speed increasing/decreasing control of the feeding means (15) according to a slack generated by intermittent feeding of the coil material (C) sent from the preceding plastic working device (2*a*) and also includes a first and a second contact sensor (13*c*, 13*d*) for stopping the preceding plastic working device (2*a*) and the feeding means (15) at the time of emergency according to the slack of the coil material (C) generated by intermittent feeding.

Due to the foregoing, when a slack of intermittent feeding of the coil material (C) sent from the preceding plastic working device (2*a*) is watched by the first and the second proximity sensor (13*a*, 13*b*), a feeding speed of the coil material (C) can be adjusted at an appropriate feeding speed. On the other hand, when the first and the second contact sensor (13*c*, 13*d*) detect the coil material (C), the entire device can be stopped by judging that the device is in the state of emergency.

In the invention described in claim 4, the second slack watching means (22) includes a first and a second laser beam sensor (22*a*, 22*b*) for executing the speed increasing/decreasing control of the preceding plastic working device (2*a*) according to the watching of the slack of the coil material (C) at the time of feeding the coil material (C) to the succeeding plastic working device (2*a*) and also includes a third and a fourth contact sensor (23*a*, 23*b*) for stopping the entire system.

Due to the foregoing, a feeding speed of the coil material (C), which is fed to the succeeding plastic working device (2*b*), can be adjusted at an appropriate feeding speed. On the other hand, when the third and the fourth contact sensor (23*a*, 23*b*) detect the coil material (C), the entire system can be stopped.

In the invention described in claim 5, the plastic working device (2) is a press device.

Due to the foregoing, it is possible to realize a press working system, the productivity of which is enhanced.

The invention described in claim 6 provides a plastic working method in which when a coil material (C), which is a workpiece, is supplied to a plurality of plastic working devices (2) and worked in order, the coil material (C) worked by the preceding plastic working device (2*a*) is intermittently sent out, the slack of the coil material (C) generated by intermittent feeding is watched and the feeding speed of the coil material (C) is controlled or the system is completely stopped, and a slack of the coil material generated at the time of feeding the coil material (C) to the succeeding plastic working device (2*b*) is watched and the operation of the preceding plastic working device (2*a*) is controlled or the system is completely stopped.

Due to the foregoing, a workpiece can be stably fed to the next plastic working device (2*b*) and it is possible to build a system which is not influenced by an intermittent feeding operation of the preceding plastic working device (2*a*).

The invention described in claim 7 provides a plastic working method in which when a coil material (C), which is a workpiece, is supplied to a plurality of plastic working devices (2) and worked in order, the coil material (C) worked by the preceding plastic working device (2*a*) is intermittently sent out, a slack of the coil material (C) generated by intermittent feeding is watched and the feeding of the coil material (C) is converted from intermittent feeding to continuous feeding and a feeding speed of the continuous feeding is controlled or the system is completely stopped, and the slack of the coil material (C) generated at the time of feeding the coil material (C) to the succeeding plastic working device (2*b*) is watched and operation of the preceding plastic working device (2*a*) is controlled or the system is completely stopped.

When intermittent feeding of the coil material (C) is converted to continuous feeding, it is possible to prevent flapping. Therefore, the slack of the coil material (C) can be easily watched.

In this connection, reference marks in the parentheses attached to the means described above show a corresponding relationship with the specific means described in the embodiment later.

The present invention may be more fully understood from the description of preferred embodiments of the invention, as set forth below, together with the accompanying drawings.

DESCRIPTION OF THE PREFERRED EMBODIMENTS

Figure 1:
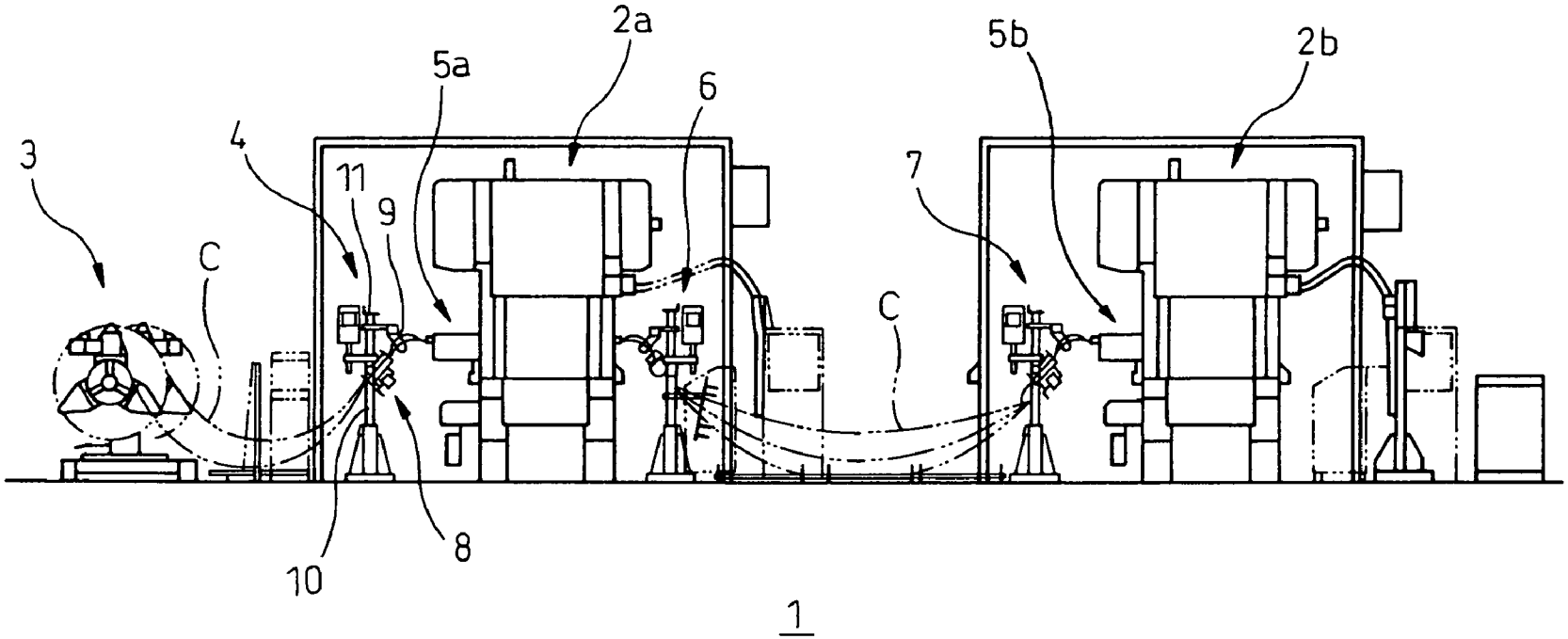
FIG. 1 is a schematic overall arrangement view showing an example of the press working line which is a plastic working device of the present invention.

FIG. 1 is a view showing a press working line 1 which is an example of the plastic working system of the present invention.

This press working line 1 includes two press devices 2 for conducting a predetermined press working on a coil material C which is a workpiece. These two press devices 2 will be referred to as a first press device 2*a* and a second press device 2*b*, hereinafter.

In other words, the press working line 1 includes: an uncoiler 3 which is a delivering means for delivering the coil material C; a first feeding device 4; an intermittently feeding mechanism 5*a*; a first press device 2*a* which is a preceding press device; a feed adjusting means 6; a second feeding device 7; an intermittently feeding mechanism 5*b*; and a second press device 2*b* which is a succeeding press device.

The first and the second press device 2*a*, 2*b* respectively have a metallic mold for executing a predetermined press working. In this connection, the fundamental constitution of the first and the second press device 2*a*, 2*b* is well known. Therefore, a detailed explanation of the first and the second press device 2*a*, 2*b* will be omitted here.

The uncoiler 3 continuously delivers a coil material C and supplies it to the first press device 2*a*, which is a preceding press device, through the first feeding device 4 and the intermittently feeding mechanism 5*a*.

Although the detailed explanations are omitted here, the first feeding device 4 is composed in such a manner that the feeding means 8 for feeding the coil material C, which is sent from the uncoiler 3, and the loop sensor 9 for detecting an amount of loop of the coil material C are arranged in the support means 10 so that heights of the feeding means 8 and the loop sensor 9 can be adjusted by the height adjusting means 11.

In this connection, a plurality of feeding rollers (not shown) for conveying the coil material C and a servo motor (not shown) for giving a drive force to one of the feeding rollers are mounted on the feeding means 8.

Figure 2:
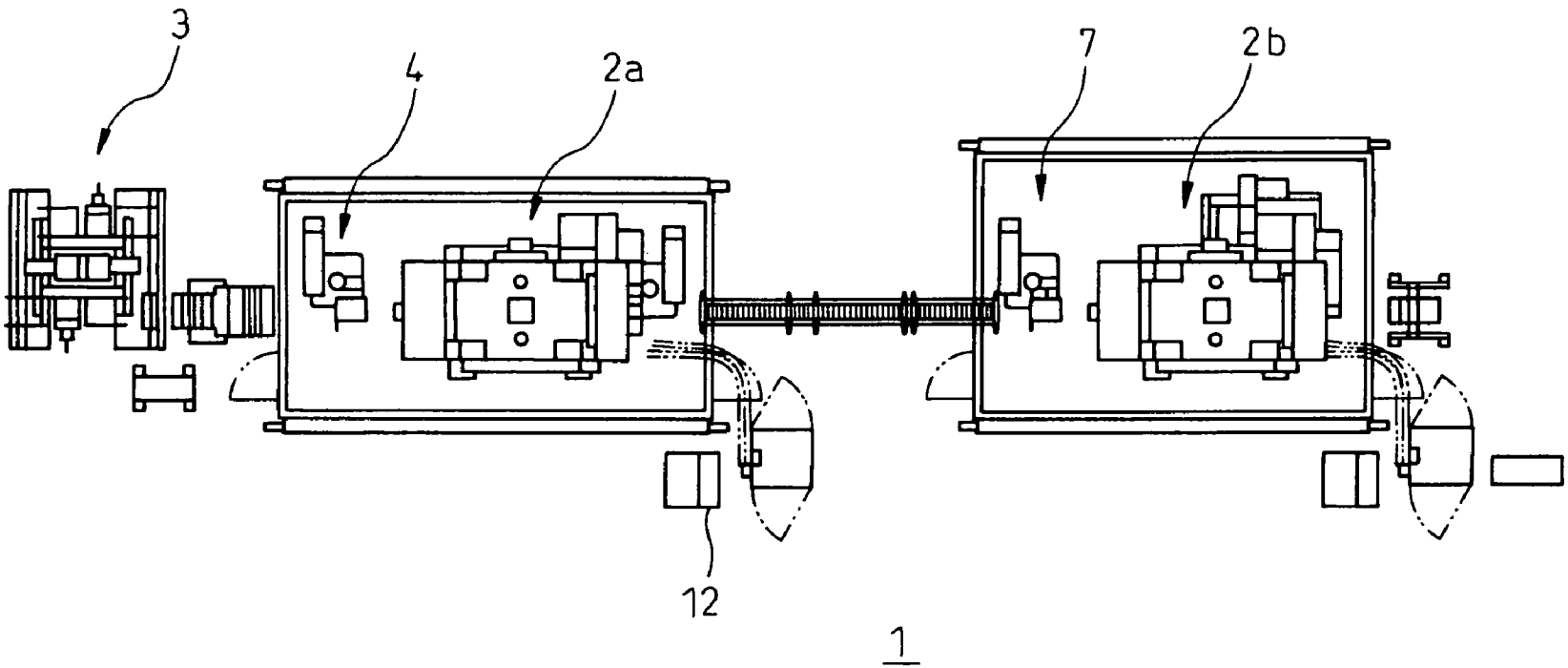
FIG. 2 is a plan view of the press working line shown in FIG. 1.

The intermittently feeding mechanism 5*a* intermittently delivers the coil material C to the first press device 2*a* at the operation timing of the first press device 2*a* according to an operation command given from the first press control and operation panel 12. Concerning this matter, refer to FIG. 2.

Figure 3:
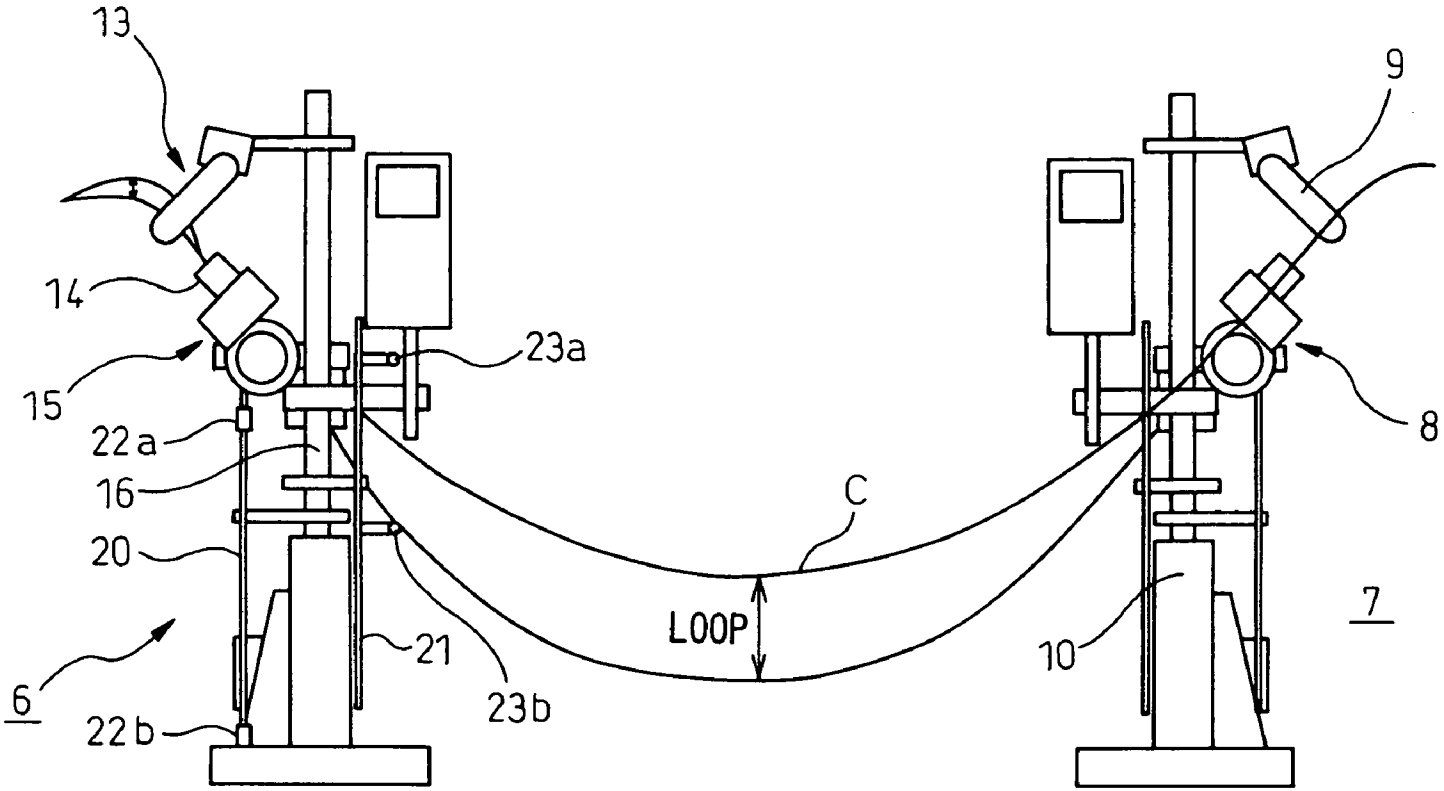
FIG. 3 is a schematic illustration of the function of feeding a workpiece to the second feeding device for feeding a workpiece to the second press device, which is a succeeding plastic working device, from a feed adjusting device in the press working line shown in FIG. 1.

The feed adjusting device 6 is arranged on the downstream side of the first press device 2*a*. The feed adjusting device 6 converts the intermittent feeding operation of the coil material C, which is intermittently delivered from the first press device 2*a* at the operation timing of the first press device 2*a*, to the continuous feeding operation. At the same time, the feed adjusting device 6 adjusts the feeding speed of the coil C at an appropriate value. Concerning this matter, refer to FIGS. 3 and 4.

In other words, the feed adjusting device 6 is composed in such a manner that the first slack watching means 13 (the loop correction sensor 13) for watching a loop length of the coil material C when the coil material C, which is delivered from the first press device 2*a*, is received and made to pass through and the feeding means 15 for converting the intermittent feeding of the coil C, which is sent through the guide member 14, to the continuous feeding by the servo motor driven being controlled by the control panel are attached to the support member 16 so that heights of the first slack watching means 13 and the feeding means 15 can be adjusted by the height adjusting means 17.

When the loop correcting sensor 13 watches a loop length of the coil material C delivered from the first press device 2*a*, the feeding speed of the feed adjusting device 6 is adjusted, i.e., the operation control (speed increasing/decreasing control) of the servo motor for driving the feeding means 15 can be executed.

Figure 4:
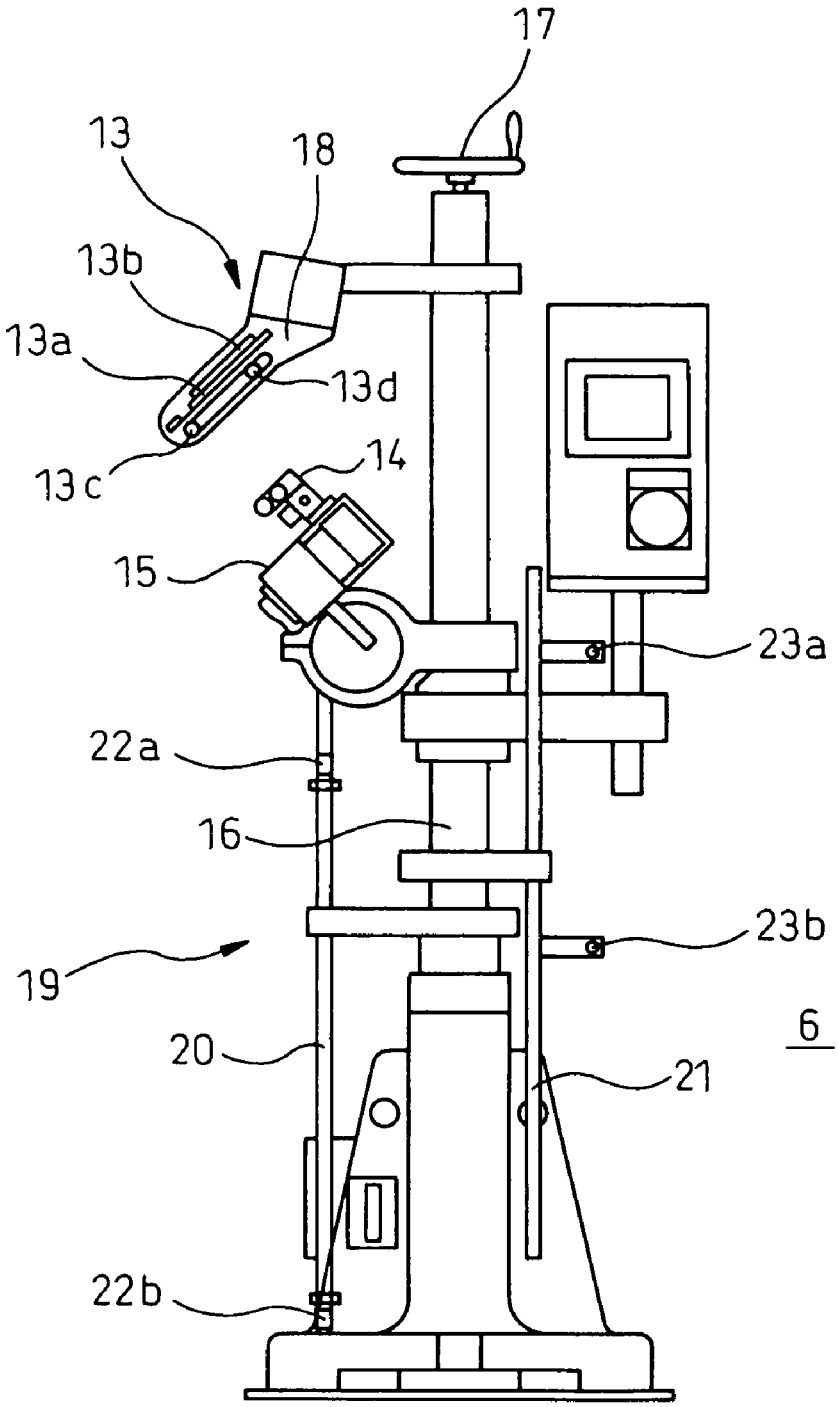
FIG. 4 is a schematic illustration showing a detailed arrangement of an example of the feed adjusting device.

The loop correction sensor 13 includes: a first and a second proximity sensor 13*a*, 13*b*; and a first and a second contact sensor 13*c*, 13*d* as shown in FIG. 4.

The first and the second proximity sensor 13*a*, 13*b* are respectively arranged at a lower and an upper position of the support arm 18. The first and the second contact sensor 13*c*, 13*d* are respectively arranged at positions closer to the feeding means 15 than the first and the second proximity sensor 13*a*, 13*b*.

When a loop length of the coil material C is watched by the above arrangement, in the case where the coil material C is detected by the first proximity sensor 13*a*, the feeding speed of the feed adjusting device 6 is higher than the speed of the coil material C sent from the first press device 2*a*. Therefore, in order to reduce the feeding speed of the feed adjusting device 6, the servo motor for driving the feeding means 15 is subjected to the speed reduction control. On the other hand, in the case where the coil C is detected by the second proximity sensor 13*b*, the speed of the coil material C sent out from the first press device 2*a* is higher than the feeding speed of the feed adjusting device 6. Therefore, in order to increase the feeding speed of the feed adjusting device 6, the servo motor for driving the feeding means 15 is subjected to the speed increasing control.

On the other hand, concerning the first and the second contact sensor 13*c*, 13*d*, in the case where the coil material C is detected by the first and the second contact sensor 13*c*, 13*d*, the device is judged to be in the state of emergency, and the system is stopped completely. An example of the emergency state is when the feeding speed of the first press device 2*a* does not agree with the feeding speed of the feed adjusting device 6 and the coil material is abnormally loosened or stretched.

Further, in the feed adjusting device 6, in the support member 16, the first and the second laser beam sensor 22*a*, 22*b*, which are non-contact sensors to be used as the second slack watching means 22 provided on the lower side of the feeding means 15, and the third and the fourth contact sensor 23*a*, 23*b*, which are used for detecting an emergency state, are respectively arranged on the attaching frames 20, 21.

The first and the second laser beam sensor 22*a*, 22*b* watch a loop (slack) of the coil material C, which has been sent out from the feed adjusting device 6, formed between the feed adjusting device 6 and the second feeding device 7 connected to the second press device 2*b*. In this case, the first laser beam sensor 22*a*, which is one of the first laser beam sensor 22*a* and the second laser beam sensor 22*b*, is attached onto the upper side of the attaching frame 19 and the second laser beam sensor 22*b* is attached onto the lower side of the attaching frame 20. Due to the foregoing, in the case where the loop (slack) of the coil material C, which has been sent out, formed between the feed adjusting device 6 and the second feeding device 7 connected to the second press device 2*b* is not detected by the first laser beam sensor 22*a* provided on the upper side, it is judged that the coil material C is stretched too strongly. Therefore, the first press device 2*a* is subjected to the speed increasing control. On the other hand, in the case where the loop is detected by the second laser beam sensor 22*b* provided on the lower side, the first press device 2*a* is subjected to the speed decreasing control.

In this connection, the operation speed of the first press device 2*a* is increased and decreased, for example, in the range of ±20 spm.

Concerning the third and the fourth contact sensor 23*a*, 23*b*, in the case where the coil material C is too weakly loosened or too strongly stretched for the reason that the feeding speed of the feed adjusting device 6 and that of the second feeding device 7, which is connected to the second press device 2*b*, do not agree with each other or for some another reason, it is judged that the entire line has been put into an emergency state. Therefore, the entire line is stopped. In this case, the third contact sensor 23*a* is attached onto the upper side of the attaching frame 21 and the fourth contact sensor 23*b* is attached to the middle portion of the attaching frame 21.

In this connection, the second feeding device 7 connected to the second press device 2*b* is composed in the same manner as that of the first feeding device 4 and the second press device 2*b* is composed in the same manner as that of the first press device 2*a*. Therefore, explanations of these devices are omitted here.

In this case, the coil material C, which is continuously sent out at a speed adjusted by the feed adjusting device 6, is fed to the second feeding device 7 while a predetermined loop of the coil material C is being maintained. Therefore, the coil material C is fed to the second feeding device 7 being not affected by the intermittent feeding of the operation timing of the first press device 2*a*.

The press working line 1, which is an example of the plastic working system of the present invention, has been explained above. Next, an operation procedure of this press working line 1 will be explained below.

First of all, by an operation starting command to the uncoiler 3, the coil material C, which is a workpiece, is continuously delivered from the uncoiler 3. At the same time, the coil material C is intermittently supplied at the operation timing, which has been set in the first press device 2*a*, through the first feeding device 4 and the intermittently feeding mechanism 5*a* by the operation conducted on the first press control and operation panel 12.

In the first feeding device 4, the coil material C is sent out to the intermittently feeding mechanism 5*a* through the feeding means 8 and the loop sensor 9. The intermittently feeding mechanism 5*a* can intermittently deliver the coil material C to the first press device 2*a* at the operation timing of the first press device 2*a* executed by an operation command given by the first press control and operation panel 12.

Next, in the first press device 2*a*, the coil material C, on which a predetermined press working has been conducted, is sent to the feeding means 15 through the loop correction sensor 13, which is provided on the feed adjusting device 6, and the guide member 14.

The loop correction sensor 13 watches a loop of the coil material C and a continuous feeding speed of the feed adjusting device 6 is controlled, i.e., the operation of the servo motor for driving the feeding means 15 is controlled (speed increasing/decreasing control).

Concerning the loop correction sensor 13, a case will be explained in which the first and the second proximity sensor 13*a*, 13*b*, which are arranged at a lower and an upper position of the support arm 18, detect the coil material C.

In the case where the coil material C is detected by the first proximity sensor 13*a*, it is judged that the feeding speed of the feed adjusting device 6 is higher than that of the coil material C sent out from the first press device 2*a*. Therefore, in order to reduce the feeding speed of the feed adjusting device 6, the servo motor for driving the feeding means 15 is subjected to the speed decreasing control.

On the other hand, in the case where the coil material C is detected by the second proximity sensor 13*b*, it is judged that the feeding speed of the coil material C, which is sent out from the first press device 2*a*, is higher than the feeding speed of the feed adjusting device 6. Therefore, in order to increase the feeding speed of the feed adjusting device 6, the servo motor for driving the feeding means 15 is subjected to the speed increasing control.

In the case where the coil material C is detected by the first and the second contact sensor 13*c*, 13*d* which are arranged at positions in the support arm 18 closer to the feeding means 15 than the first and the second proximity sensor 13*a*, 13*b*, it is judged that the state is in an emergency, for example, the feeding speed of the first press device 2*a* does not agree with that of the feed adjusting device 6 and the coil material C is abnormally loosened or stretched. Alternatively, it is judged that the first press device 2*a* can not be normally operated for some reasons. Therefore, the entire system can be stopped.

The coil material C, which has been delivered from the feeding means 15 of the feed adjusting device 6, is sent to the second press device 2*b* through the second feeding device 7 and then subjected to press working. In this case, the coil material C is sent to the second feeding device 7 under the condition that a predetermined loop is formed.

In this case, the coil material C is delivered from the feeding means 15 of the feed adjusting device 6 under the condition that the intermittent feeding is converted to the continuous feeding. Therefore, it is possible to reduce flapping caused by the intermittent feeding. In this case, a state of the loop of the coil material C can be suitably watched by the first and the second laser beam sensor 22*a*, 22*b*, which are arranged in the attaching frames 20, 21 of the support member 16, and by the third and the fourth contact sensor 23*a*, 23*b* used for detecting a state of emergency.

In this case, in the case where a loop (slack) of the coil material C, which has been delivered, is not detected by the first laser beam sensor 22*a* attached on the upper side of the attaching frame 19, it is judged that the coil material C is too strongly stretched. Therefore, the first press device 2*a* is subjected to the speed increasing control.

On the other hand, in the case where a loop of the coil material C is detected by the second laser beam sensor 22*b* provided on the lower side, the first press device 2*a* can be subjected to the speed decreasing control.

In the case where the coil material C is detected by the third contact sensor 22*a*, which is attached onto the upper side of the attaching frame 20, and by the fourth contact sensor 22*b*, which is attached in the middle portion of the attaching frame 20, it is judged that the feeding speed of the feed adjusting device 6 and that of the second feeding device 7, which is connected to the second press device 2*b*, do not agree with each other or loosening of the coil material C too much or the overstretch are caused in some reasons. Due to the foregoing, the line is judged to be in an emergency state and is stopped.

As described above, the loop of the coil material C, which has been delivered from the feeding means 15 of the feed adjusting device 6, is watched and the first press device 2*a* is subjected to the speed increasing/decreasing control so that the loop of the coil material C can be maintained in a predetermined range. Therefore, the coil material C can be sent through the second feeding device 7 without being affected by the intermittent operation of the first press device 2*a*.

The press working line 1 has been explained above as an example of the plastic working system of the present invention. However, the present invention is not limited to the above press working line 1 and further the number of the press devices 2 is not limited to two and it is possible to apply the present invention to the press devices, the number of which is three or more. Furthermore, the present invention can be applied to another plastic working system.

While the invention has been described by reference to specific embodiments chosen for purpose of illustration, it should be apparent, to those skilled in the art, that numerous modification could be made thereto without departing from the basic concept and scope of the invention.

The invention claimed is:

1. A plastic working system in which a coil material, which is a workpiece, is converted to be intermittently sent to a press device of a plurality of press devices and plastically worked, the plurality of press devices being arranged so that the coil material is worked by the plurality of press devices in order, comprising:

a first slack watching means for watching a slack which is generated in the coil material intermittently sent out from one press device by intermittent feeding;

a second watching means for watching a slack of the coil material generated at the time of feeding the coil material to a succeeding press device; and a feed adjusting device for controlling an operation speed of a preceding press device or a feeding speed at the time of feeding the coil material to the succeeding press device, wherein the feed adjusting means includes a feeding means for converting intermittent feeding of the coil material to continuous feeding of the coil material sent from the first slack watching means, wherein operation of the feeding means is controlled according to a slack, which is watched by the first slack watching means, caused by intermittent feeding of the coil material which is sent from the preceding press device, and wherein a slack of the coil material, at the time of feeding the coil material to the succeeding press device, is watched by the second watching means so as to control operation of the preceding press device.

2. A plastic working system according to claim 1, wherein the first slack watching means includes a first and a second proximity sensor for executing the speed increasing/decreasing control of the feeding means according to the slack caused by intermittent feeding of the coil material sent from the preceding press device and also includes a first and a second contact sensor for stopping the preceding press device and the feeding means at a time of emergency according to the slack of the coil material caused by intermittent feeding.

3. A plastic working system according to claim 1, wherein the second slack watching means includes a first and a second laser beam sensor for executing the speed increasing/decreasing control of the preceding press device according to the watching of the slack of the coil material at the time of feeding the coil material to the succeeding press device and also includes a third and a fourth contact sensor for stopping the entire system.

4. A plastic working method, wherein when a coil material, which is a workpiece, is supplied to a system comprising a plurality of press devices and worked in order, the coil material worked by a preceding press device is intermittently sent out, the method comprising:

watching a slack of the coil material generated by intermittent feeding and converting a feeding of the coil material from intermittent feeding to continuous feeding and controlling a feeding speed of the continuous feeding or completely stopping the system, and watching a slack of the coil material generated at the time of feeding the coil material to a succeeding press device and controlling operation of the preceding press device or completely stopping the system.

* * * * *